US005446431A

United States Patent [19]

Leach et al.

[11] Patent Number: 5,446,431

[45] Date of Patent: Aug. 29, 1995

[54] GROUND FAULT MODULE CONDUCTORS AND BASE THEREFOR

[75] Inventors: Thomas C. Leach, Lexington, Ky.; Duane L. Turner; Darryl Carter, both of Cedar Rapids, Iowa

[73] Assignee: Square D Company, Palatine, Ill.

[21] Appl. No.: 234,335

[22] Filed: Apr. 28, 1994

[51] Int. Cl.[6] ..... H01H 73/00

[52] U.S. Cl. ..... 335/18; 335/202

[58] Field of Search ..... 335/18, 202; 361/42–50

[56] References Cited

U.S. PATENT DOCUMENTS 4,000,444 12/1976 Douglas et al. ..... 335/18

5,179,491 1/1993 Runyan ..... 335/18

*Primary Examiner*—Lincoln Donovan

*Attorney, Agent, or Firm*—Larry I. Golden; Kareem M. Irfan

[57] ABSTRACT

A ground fault module is provided for protecting a circuit interrupter connected between the load and line terminals of a phase and neutral power line. The module includes a sensor for detecting a current imbalance between the phase and neutral power lines. A phase conductor having a rigid, elongated body made of solid, electrically-conducting material with a first and second end is adapted for connection to the load and line phase power line. A neutral conductor having a rigid, elongated body made of solid, electrically-conducting material with a first and second end is adapted for connection to the load and line neutral power line. Preferably, terminals are used to clamp the ends of the phase and neutral conductors to the load power line and load neutral line. The phase and neutral conductor are operatively connected to the sensor. The present invention also provides a housing assembly for a ground fault circuit interrupter which includes a base made of electrically insulating material with a plurality of cavities for retaining the ground fault module and terminals therein.

12 Claims, 4 Drawing Sheets

22
24
26
28
30
32
34
36
38
40
42
44
46
48
50
52
54
56
58
60
62
64
66
68
70
72
74
76
78
80
82
84
86
88
90
94
96
98
100
102
18
20

GROUND FAULT MODULE CONDUCTORS AND BASE THEREFOR

FIELD OF THE INVENTION

The present invention relates to conductors and terminals used for making electrical connections between phase and neutral power lines and the components of a ground fault module within circuit interrupters and the like.

BACKGROUND OF THE INVENTION

The electrical systems in residential, commercial and industrial applications usually include a panelboard for receiving electrical power from a utility source. The power is then routed through overcurrent protection devices to designated branch circuits supplying one or more loads. These overcurrent devices are typically circuit interrupters such as circuit breakers and fuses which are designed to interrupt the electrical current if the limits of the conductors supplying the loads are surpassed. Interruption of the circuit reduces the risk of injury or the potential of property damage from a resulting fire.

Circuit breakers are a preferred type of circuit interrupter because a resetting mechanism allows their reuse. Typically, circuit breakers interrupt an electric circuit due to a trip condition such as a current overload or ground fault. The current overload condition results when a current exceeds the continuous rating of the breaker for a time interval determined by the trip current. The ground fault trip condition is created by an imbalance of currents flowing between a line conductor and a neutral conductor such as a grounded conductor, a person causing a current path to ground, or an arcing fault to ground.

An example of a ground fault interrupter is a fast acting circuit breaker that disconnects equipment from the power line when some current returns to the source through a ground path. Under normal circumstances all current is supplied and returned within the power conductors. But if a fault occurs and leaks some current to ground, then the ground-fault circuit interrupter (GFCI) will sense the difference in current in the phase and neutral power conductors. If the fault level exceeds the trip level of the GFCI, then the circuit will be disconnected. The trip level for protection of personnel is usually in the range of about 4 mA to 6 mA. The trip level for the protection of equipment is usually about 30 mA.

GFCIs commonly have an electronic circuit board or discrete components that are interconnected by multistrand wires. For example, a transformer is often used to sense the current imbalance between phase and neutral power lines connected to wires which are positioned within the transformer's magnetic field or transformer window. A change in the position of wires within the magnetic field affects the transformer's ability to sense current flow and generate a reliable signal. Accordingly, a problem arises to ensure the accuracy and repeatability of the wires' position during assembly. The wires' flexibility also increases the difficulty of locating their position with the precision required to use automated equipment for quality assurance testing. Furthermore, a short circuit current often generates a high magnetic force which can deflect the wires, changing their position and affecting their ability to sense current flow.

The prior art as exemplified in U.S. Pat. No. 4,568,899 issued to May et al. discloses a ground fault accessory for a circuit breaker. Wires are used as the leads and connectors between a trip circuit and a neutral conductor or to other components such as a circuit board. The wires cause several problems. Routing of the wires during assembly of the circuit breaker requires a disproportionate amount of time and expense and complicates automation of the assembly process. Placement of the wires in close proximity to one another can also lead to arcing during high voltage surges. Any damage to the wiring insulation can lead to a dielectric breakdown and a short circuit condition.

The need arises to overcome the problems associated with using wire for making electrical connections between components and terminals of a ground fault module. The present invention provides rigid, solid conductors between the terminals of a ground fault module. The assembly of the ground fault module with the inventive conductors is accurate and reproducible, effectively preventing arcing with other components of the module.

SUMMARY OF THE INVENTION

In accordance with the present invention, a ground fault module is provided for protecting a circuit interrupter connected between the load and line terminals of a phase and neutral power line. The module includes means for sensing a current imbalance between the phase and neutral power lines. The sensing means is mounted within the circuit interrupter. Also included is a phase conductor having a rigid, elongated body made of solid, electrically-conducting material with a first and second end. The first end is adapted for connection to the load phase power line. The second end is fastened to the line phase power line. The phase conductor is operatively connected to the sensing means. The module also includes a neutral conductor having a rigid, elongated body made of solid, electrically-conducting material with a first and second end. The first end is adapted for connection to the load neutral power line. The second end has a terminal for electrical connection to line neutral power line. The neutral conductor is operatively connected to the sensing means.

The present invention also provides a housing assembly for a ground fault circuit interrupter connected between the load and line terminals of a phase and neutral power line. The assembly includes a base made of electrically insulating material with a plurality of cavities. Each cavity is defined by upstanding side, top, and bottom walls integrally formed with the base. Each cavity has one face open parallel to the base. A first of the plurality of cavities is adapted to retain a circuit board between the upstanding walls and the base whereby the circuit board is inserted into the first cavity along an axis perpendicular to the open face. A second of the plurality of cavities is positioned adjacent to the first cavity. The second cavity has a first slot in one of the upstanding side walls which connects the first and second cavities and is adapted to insert a phase conductor therethrough. The second cavity has a second slot in the opposite upstanding side wall which allows access external to the assembly and is adapted to insert a load phase power line therethrough. The second cavity has a third slot in the upstanding top wall which allows access external to the assembly and is adapted to insert a terminal fastener therethrough. The second cavity is adapted to retain a phase terminal whereby the phase terminal is inserted into the second cavity along an axis perpendicular to the open face with the upstanding walls abutting the phase terminal. A third of the plurality of cavities is positioned adjacent to the first cavity. The third cavity has a first slot in one of the upstanding side walls which connects the first and third cavities and is adapted to insert a neutral conductor therethrough. The third cavity has a second slot in the opposite upstanding side wall which allows access external to the assembly and is adapted to insert a load neutral power line therethrough. The third cavity has a third slot in the upstanding top wall which allows access external to the assembly and is adapted to insert a terminal fastener therethrough. The third cavity is adapted to retain a neutral terminal whereby the neutral terminal is inserted into the third cavity along an axis perpendicular to the open face with the upstanding walls abutting the neutral terminal.

The present invention also provides a ground fault circuit interrupter for protecting a circuit connected between the load and line terminals of a phase and neutral power line. The interrupter includes an electrically-insulating housing having a base with a plurality of cavities. Each cavity is defined by upstanding side, top, and bottom walls integrally formed with the base. Each cavity having one face open parallel to the base. A first of the plurality of cavities is adapted to retain a ground fault module between the upstanding walls and the base whereby the module is inserted into the first cavity along an axis perpendicular to the open face. The interrupter also includes a ground fault module as previously described above.

Accordingly, an object of the invention is to provide rigid, solid conductors for electrical connection between components of a ground fault module and the phase and neutral power lines which reduces or eliminates wire connections and their associated failure modes.

Another object of the invention is to increase the accuracy and repeatability of a ground fault module's operation by using rigid, solid conductors in the transformer window.

A further object of the invention is to provide a ground fault module which has fewer component parts, requires fewer wire connections, and promotes automated assembly.

Yet another object of the invention is to provide a ground fault module which prevents high voltage surge arcing between conductors, terminals and other components of the module.

A still further object of the invention is to provide rigid conductors that promote inexpensive quality assurance by placing the conductors in the same relative position during assembly for location by automated test equipment probes.

Other and further advantages, embodiments, variations and the like will be apparent to those skilled in the art from the present specification taken with the accompanying drawings and appended claims.

BRIEF DESCRIPTION OF THE DRAWINGS

In the drawings, which comprise a portion of this disclosure.

DETAILED DESCRIPTION

Figure 1:
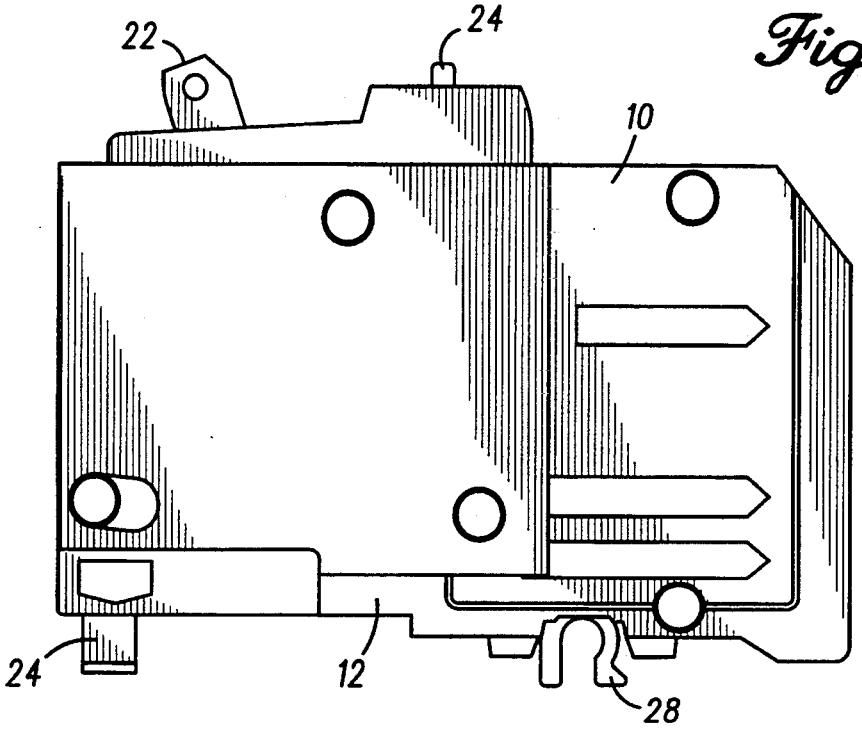
FIG. 1 is a side view of an embodiment of the present invention illustrating a circuit interrupter.
Figure 2:
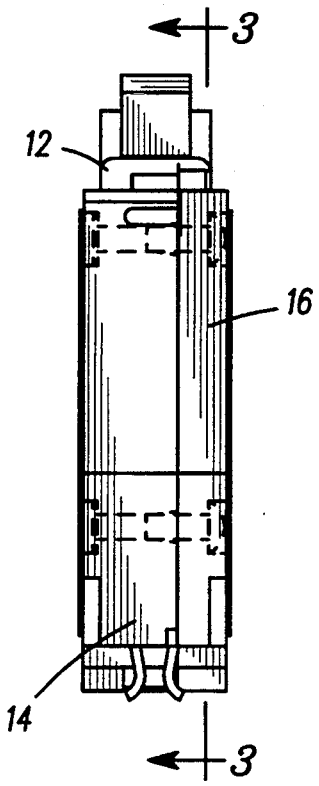
FIG. 2 is an end view of the circuit interrupter illustrated in FIG. 1.
Figure 3:
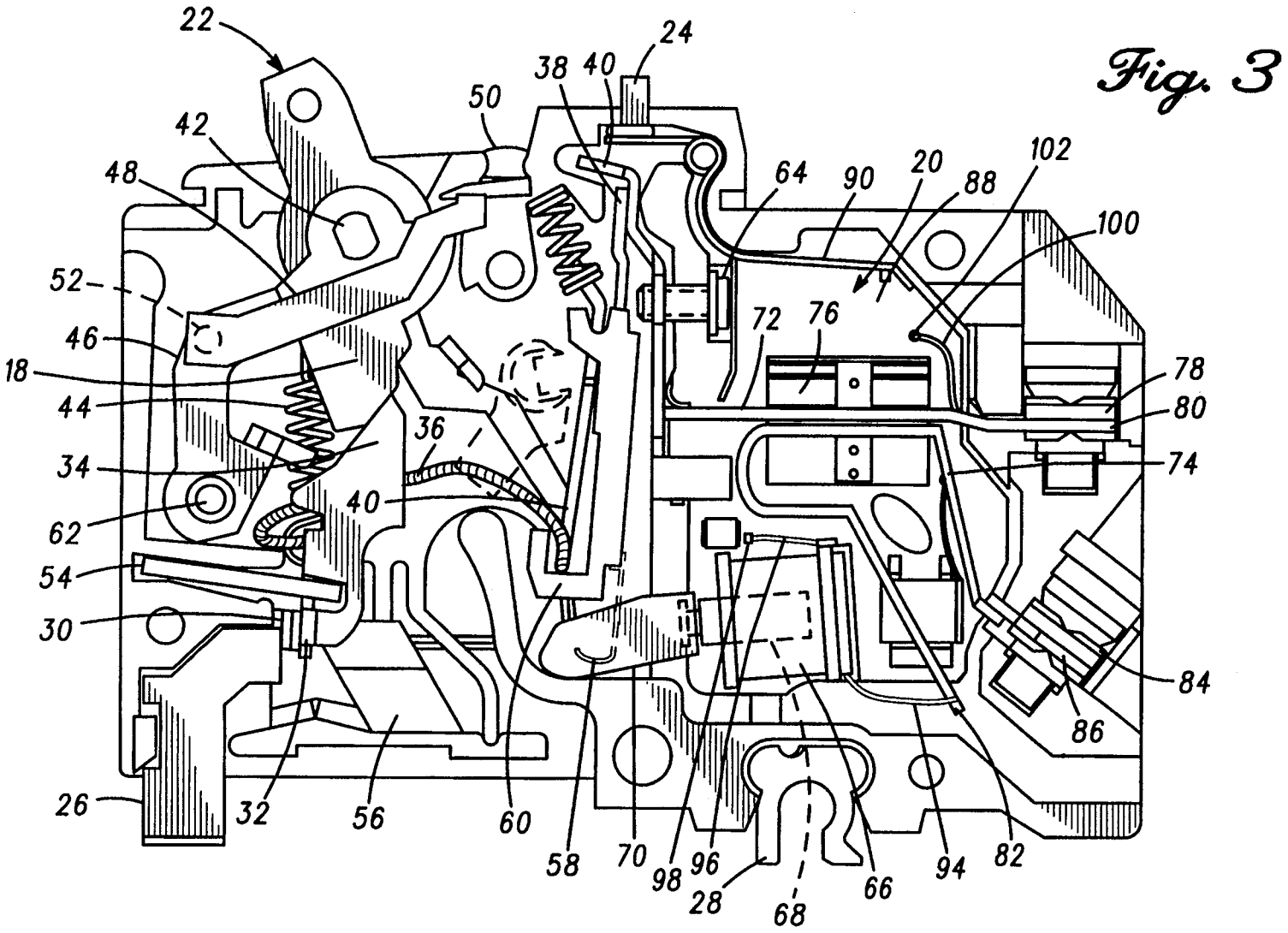
FIG. 3 is a cross-sectional view taken along lines 3—3 of FIG. 2 illustrating a first embodiment of the inventive conductors and terminals in a ground fault module.

A preferred embodiment of the present invention is depicted in the form of a ground fault circuit interrupter (GFCI) 10 in FIGS. 1, 2 and 3. The GFCI 10 includes a housing assembly 12 having an electrically-insulating base 14 closed at one face by a detachable cover 16 which together enclose the components of the operating mechanism and a ground fault module, generally designated as 18 and 20 respectively. An operating handle 22 and test button 24 are mounted through separate openings in the base 14 for external manual operation. Similarly, a jaw-like terminal 26 extends through the base 14 to be externally accessible for electrical connection to the line side of a phase power line. A clip 28 secured to the housing mounts the circuit interrupter 10 to a panelboard (not shown) or the like.

Referring specifically to FIG. 3, the circuit path between a source and load (not shown) starts with the jaw terminal 26 carrying current through a stationary contact 30 which is aligned to reversibly engage a movable contact 32. The movable contact 32 may be formed as part of a carrier 34 which carries the current through a flexible conductor 36 to a bimetal conductor assembly 38 which includes a rigid conductive terminal 40 welded thereto. The bimetal conductor assembly 38 carries the current to the ground fault module 20 as will be discussed in more detail below.

Manual control of the operating mechanism 18 is provided using the operating handle 22 pivotally mounted about an axis 42 in the housing 12 to control the carrier 34. The upper end of the carrier 34 is rotatably secured to the bottom of the operating handle 22 so that the carrier 34 can be rocked clockwise and counterclockwise using a toggle spring 44. The toggle spring 44 is secured to the bottom of the carrier 34 and to an equilibrium position on a trip lever 46 so as to urge the carrier 34 toward the operating handle 22.

In response to movement of the handle 22 to the right or left, the carrier 34 is moved counterclockwise or clockwise, respectively, by the action of the toggle spring 44. The operating handle 22 moves the top of the carrier 34 to either side of the equilibrium position, so that the bottom of the carrier 34 biases the movable contact 32 to either the open or closed position.

A flag armature 48 which is externally visible through a lens 50 indicates the position of the movable contact 32 by connecting to the trip lever 46 at a reset pin 52. The components of the operating mechanism 18 are shielded by a slide 54 and an arc chute 58 from any arcing caused during the opening and closing the contacts 30 and 32.

The operating mechanism 18 is also controlled by the trip lever 46. Upon the occurrence of a moderately sustained overload condition when the contacts 30 and 32 are in a closed position, the temperature of the bimetal conductor assembly 38 increases and flexes to the right. In response to the flexing action, an armature 58 and a yoke 60 swing counterclockwise so as to release the stand-off pressure of the end of the trip lever 46. The trip lever 46 rotates clockwise about pin 62 causing the toggle spring 44 to pull the carrier 34 away from the stationary contact 30 so as to interrupt the current path.

Similarly, upon the occurrence of an extensive current overload condition, the yoke 60 manifests a magnetic force that attracts the armature 58 causing it to rotate counterclockwise. Consequently, the trip lever 46 responds by rotating clockwise and the toggle spring 44 pulls the carrier 34 away from the stationary contact 30 to disrupt the current path.

After being tripped, the trip lever 46 is reset by rotating the operating handle clockwise so that the bottom of the operating handle 22 pushes reset pin 52. The force acting on the reset pin 52 rotates the trip lever 46 counterclockwise to allow the end of the trip lever 46 to engage and set the armature 48.

The response of the tripping lever 48 to the appropriate tripping condition is set by a calibration screw 64. The calibration screw 64 engages the conductive terminal 40 causing it to rotate right or left to consequently change the position of the bimetal conductor assembly 38, armature 48 and yoke 60. The calibration screw 64 is externally accessible.

The above-described current path and components are similar in structure and operation to the corresponding components in U.S. Pat. No. 4,623,859, entitled "Remote Control Circuit Breaker," issued Nov. 18, 1986, and assigned to the instant assignee. The entire disclosure of this patent is hereby incorporated by reference.

The operating mechanism 18 is also controlled by the ground fault module 20. In response to a signal from the ground fault module 20, a solenoid 66 drives a plunger 68 and an associated trip link 70 to engage the armature 58. As previously described, rotating the armature 58 consequently causes the trip lever 46 to disrupt the current path.

The ground fault circuit module 20 measures an imbalance in the current flow through a phase conductor 72 and a neutral conductor 74 using a coil assembly 76. The phase conductor 72 connects at one end to the conductor terminal 40 and bimetal conductor assembly 38. Preferably, the end of the phase conductor 72 is rigidly affixed to the conductor terminal 40 by a spot weld. The phase conductor 72 extends through the coil assembly 76 and connects to a load phase terminal 78 at the opposite end. A conventional clamp plate 80 is integrally formed at the opposite end of the phase conductor 72 for reversible connection with the load phase terminal 78.

Similarly, the neutral conductor 74 connects at one end to a line neutral terminal 82, extends through the coil assembly 76, and connects to the load neutral terminal 84 at the opposite end. A clamp plate 86 is integrally formed at the end of the neutral conductor 74 for reversible connection with the load neutral terminal 84.

The coil assembly 76 outputs a signal to a conventional electronic signal processor mounted on a circuit board 88. A suitable coil assembly 76 is a transformer or other means for sensing a current imbalance between line and neutral conductors. The coil assembly 76 is fully described in copending U.S. patent application Ser. No. 08/182,920 which application is commonly assigned hereto and incorporated by reference. The discrete electrical components are omitted from the circuit board 88 for the purposes of clarity.

The ground fault module 20 also provides a test circuit to simulate a ground fault using a spring 90 to complete the current path from the conductor terminal 40 to the electronic signal processor on the circuit board 88. The test circuit is fully described in copending U.S. patent application Ser. No. 08/221,424 which application is commonly assigned hereto and incorporated by reference.

The solenoid 66 is preferably mounted on the circuit board 88. A solenoid lead 66 connects the solenoid 92 to the neutral conductor 74 near the line neutral terminal 82. A neutral board lead 96 connects to the other end of the solenoid 66 to the circuit board 88 with a crimp connector 98 therethrough. The solenoid lead 94 and neutral board lead 96 place the solenoid 66 in electrical series between the circuit board 88 and a potential source of high voltage input at the line neutral terminal 84. Accordingly, the solenoid 66 acts as an absorber of dielectric shocks preventing damage to the circuit board 88.

A phase board lead 100 delivers power to the circuit board 88 with a crimp connector 102 therethrough. The opposite end of the phase board lead 100 is connected to the end of the phase conductor 72 near the load phase terminal 78.

Other embodiments of the conductors and terminals in the ground fault module and their mounting in a base are contemplated by the present invention. These embodiments are for illustrative purposes only and are not intended to be limiting.

Figure 4:
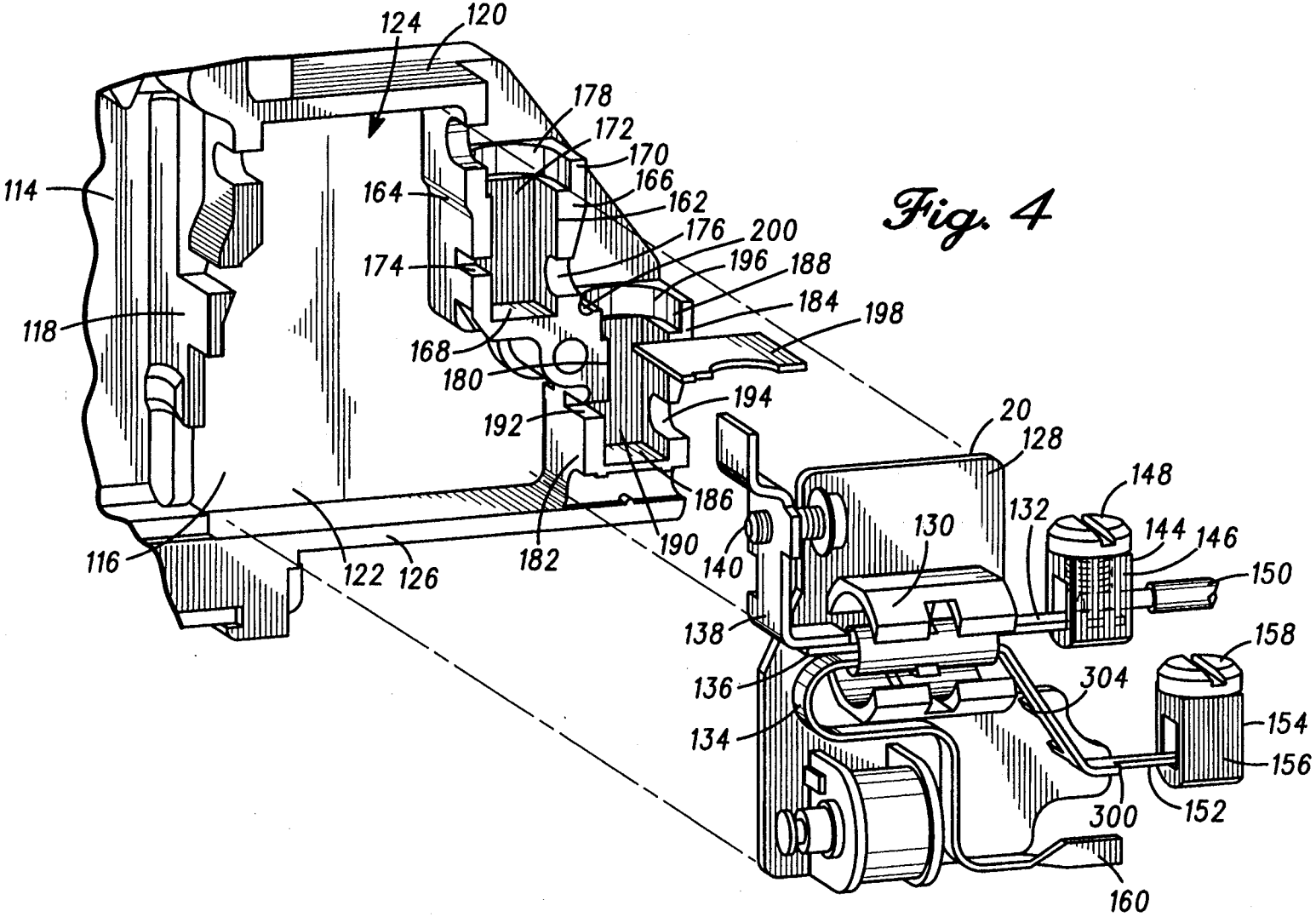
FIG. 4 is an exploded, fragmentary side view of a second embodiment of the inventive conductors and terminals in a ground fault module.

A second inventive embodiment is illustrated in FIG. 4. The portion of a base 114 depicted includes a plurality of cavities like 116 defined by upstanding walls like side wall 118 and top wall 120 which are integrally formed with the generally planar back wall 122. Each of the cavities like 116 have an open face 124 through which the ground fault module 20 is inserted in a perpendicular direction thereto. The top ends like 126 of the upstanding walls generally terminate in the same plane to form a meshing abutment with a cover for the open face 124 as is specifically illustrated in FIGS. 1 and 2 as reference numeral 16.

The first cavity 116 retains a circuit board 128 between the upstanding walls like top wall 120 and side wall 118 and against the back wall 122. Mounted on the circuit board 128 is a coil assembly 130 with the windings removed for clarity. A phase conductor 132 and a neutral conductor 134 are positioned through the center of the coil assembly 130. As discussed above, the phase conductor 132 and neutral conductor 134 intersect the magnetic field or transformer window generated by the coil assembly 130 when it is energized.

One end 136 of the phase conductor is connected with a spot weld to a rigid conductor terminal 138 having a calibration screw 140. The opposite end 142 of the phase conductor is connected with a load phase terminal 144 which includes a phase lug body 146 and a threaded fastener 148. The opposite end 142 of the phase conductor enters the phase lug body 146 from one side and a phase power line 150 enters from the other side. As shown in phantom, the threaded fastener 148 is tightened downwardly to clamp the phase power line 150 against the opposite end 142 of the phase conductor to complete the electrical connection therebetween.

Similarly, one end 152 of the neutral conductor connects to a load neutral terminal 154 which includes a neutral lug body 156 and a threaded fastener 158. The opposite end 160 of the neutral conductor is shaped to connect to line neutral power line having a conventional pigtail connector (not shown).

A second cavity 162 is positioned adjacent to the first cavity 116. The second cavity 162 retains the phase lug body 146 between the upstanding walls like a side wall 164, an opposite side 166, a bottom wall 168 and a top wall 170 and against a back wall 172. In this embodiment, the back wall 172 is in a different plane than the further recessed back wall 122 of the first cavity. The phase lug body 146 is inserted into the second cavity 162 along an axis perpendicular to the open face 126. The second cavity includes a first slot 174 in the side wall 164 which connects the first and second cavities 116, 162 and provides for passage of the phase conductor 132 therethrough. A second slot 176 in the opposite side wall 166 provides external access for the phase power line 150 to the phase lug body 146 for electrical connection therewith. A third slot 178 in the top wall 170 provides external access for the fastener 148 to threadingly engage the phase lug body 146.

A third cavity 180 is also positioned adjacent to the first cavity 116. The third cavity 180 retains the neutral lug body 156 between the upstanding walls like a side wall 182, an opposite side 184, a bottom wall 186 and a top wall 188 and against a back wall 190. The back wall 190 is further recessed than the back wall 172 of the second cavity. The neutral lug body 156 is inserted into the third cavity 180 along an axis perpendicular to the open face 126. The third cavity 180 includes a first slot 192 in the side wall 182 which connects the first and third cavities 116, 180 and provides for passage of the neutral conductor 134 therethrough. A second slot 194 in the opposite side wall 184 provides external access for the neutral power line (not shown) to the neutral lug body 156 for electrical connection therewith. A third slot 196 in the top wall 186 provides external access for the fastener 158 to threadingly engage the neutral lug body 156.

A flat, dielectric shield 198 removably covers the third slot 196 in the top wall of the third cavity. The shield 198 provides a barrier to prevent inadvertent contact between the phase power line 150 or any of the operator's tools and the top of the neutral fastener 158. One end of the shield 198 reversibly engages a groove 200 on the external surface of the base 114 to retain the shield in position.

Compared to the prior art, the base embodiment 114 reduces the potential occurrence of an arc between the phase and neutral terminals 144, 154 during a high voltage surge. The third cavity 180 is recessed deeper than the second cavity 162 which positions the respective neutral and phase terminals 154, 144 in two different planes parallel to the back wall 122. As a result, the depth of the terminals 144, 154 only slightly overlap. The distance between the phase and neutral terminals 144, 154 is further increased by offsetting their position along the length of the base 114 to form a cascade relationship. Extending the length of the neutral conductor so that end 152 connects with the load neutral terminal 154 makes the cascade relationship feasible.

Figure 5:
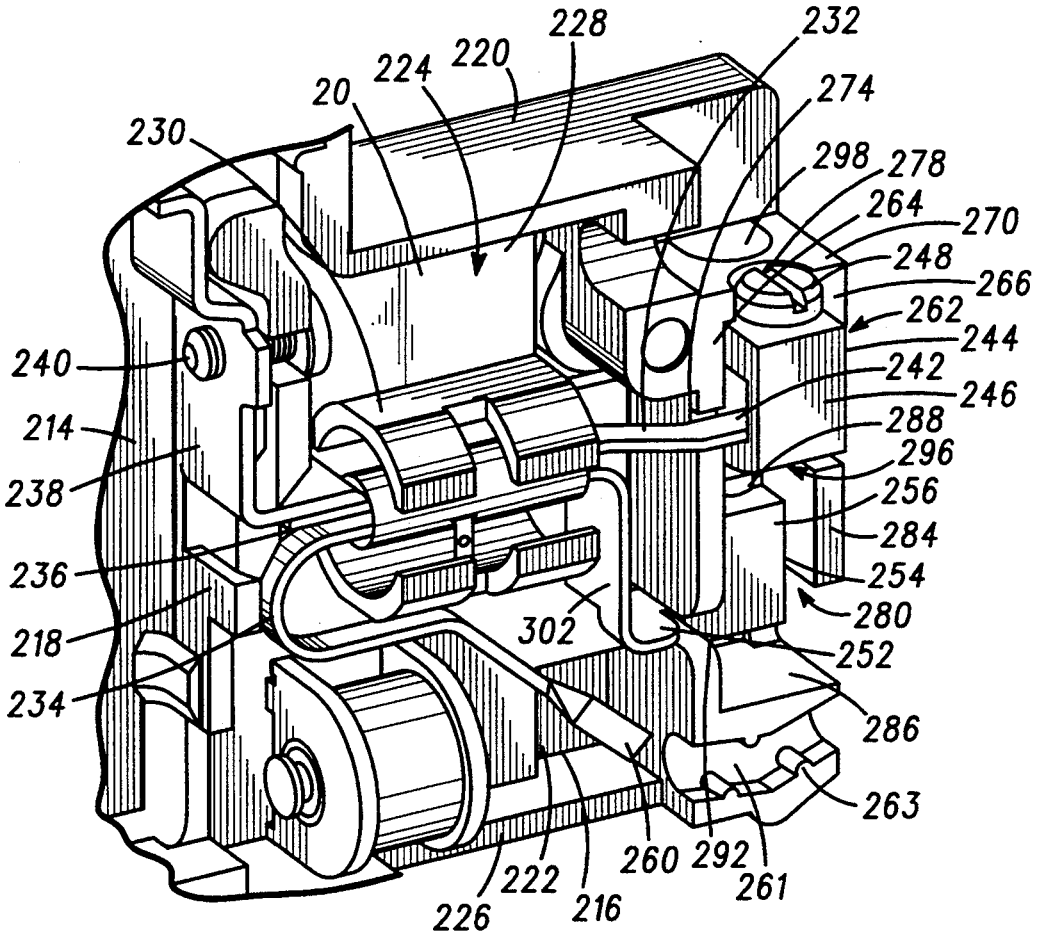
FIG. 5 is a fragmentary side view of a third embodiment of the inventive conductors and terminals in a ground fault module.

A third inventive embodiment is illustrated in FIG. 5. The portion of a base 214 depicted includes a plurality of cavities like 216 defined by upstanding walls like side wall 218 and top wall 220 which are integrally formed with the generally planar back wall 222. Each of the cavities like 216 have an open face 224 through which the ground fault module 20 is inserted in a perpendicular direction thereto. The top ends like 226 of the upstanding walls generally terminate in the same plane to form a meshing abutment with a cover for the open face 224 as is specifically illustrated in FIGS. 1 and 2 as reference numeral 16.

The first cavity 216 retains a circuit board 228 between the upstanding walls like top wall 220 and side wall 218 and against the back wall 222. Mounted on the circuit board 228 is a coil assembly 230 with the windings removed for clarity. A phase conductor 232 and a neutral conductor 234 are positioned through the center of the coil assembly 230. As discussed above, the phase conductor 232 and neutral conductor 234 intersect the magnetic field or transformer window generated by the coil assembly 230 when it is energized.

One end 236 of the phase conductor is connected with a spot weld to a rigid conductor terminal 238 having a calibration screw 240. The opposite end 242 of the phase conductor is connected with a load phase terminal 244 which includes a phase lug body 246 and a threaded fastener 248. The opposite end 242 of the phase conductor enters the phase lug body 246 from one side and a phase power line (not shown) enters from the other side. The threaded fastener 248 is then tightened downwardly to clamp the phase power line against the opposite end 242 of the phase conductor to complete the electrical connection therebetween.

Similarly, one end 252 of the neutral conductor connects to a load neutral terminal 254 which includes a neutral lug body 256 and a threaded fastener 258. The opposite end 260 of the neutral conductor is shaped to connect to line neutral power line having a conventional pigtail connector (not shown). The conventional connector inserts through channel 261 to provide an external connection. Nubs like 263 along the walls of the channel 261 relieve strain on the connector.

A second cavity 262 is positioned adjacent to the first cavity 216 and retains the phase lug body 246 between the upstanding walls like a side wall 264, an opposite side 266, a top wall 270 and against a back wall. In this embodiment, the back wall of the second cavity 262 is in a different plane than the further recessed back wall 222 of the first cavity. The phase lug body 246 is inserted into the second cavity 262 along an axis perpendicular to the open face 226. The second cavity includes a first slot 274 in the side wall 264 which connects the first and second cavities 216, 262 and provides for passage of the phase conductor 232 therethrough. A second slot in the opposite side wall 266 provides external access for the phase power line to the phase lug body 246 for electrical connection therewith. A third slot 278 in the top wall 270 provides external access for the fastener 248 to threadingly engage the phase lug body 246.

A third cavity 280 is also positioned adjacent to the first cavity 216. The third cavity 280 retains the neutral lug body 256 between the upstanding walls like a side wall 282, an opposite side 284, a bottom wall 286 and a top wall 288 and against a back wall. The top wall 288 is also the bottom wall of the second cavity 262. The back wall of the third cavity 280 is further recessed than the back wall of the second cavity. The neutral lug body 256 is inserted into the third cavity 280 along an axis perpendicular to the open face 226. The third cavity 280 includes a first slot 292 in the side wall 282 which connects the first and third cavities 216, 280 and provides for passage of the neutral conductor 234 therethrough. A second slot in the opposite side wall 284 provides external access for the neutral power line (not shown) to the neutral lug body 256 for electrical connection therewith. A third slot 296 through the top wall 286 connects with a channel extending along the back wall of the second cavity 262 which ends with an aperture 298 in the casing. The aperture 298 is shaped to provide external access for a screwdriver or other tool to reach the fastener 258 for rotating its threads against the neutral lug body 256. Contact between the tool reaching into the aperture 298 and the phase terminal 244 is prevented by the back wall of the second cavity 262.

Compared to the prior art, the base embodiment 214 reduces the potential occurrence of an arc between the phase and neutral terminals 244, 254 during a high voltage surge. The third cavity 280 is recessed substantially deeper than the second cavity 262 which positions the respective neutral and phase terminals 254, 244 in two different planes parallel to the back wall 222. As a result, there little or no overlap in the depth of the terminals 244, 254.

The phase and neutral conductors of the present invention have rigid, elongated bodies made of solid, electrically-conducting material. Suitable materials include stainless steel or a copper alloy. The dimensional size of the conductors is generally determined by two factors well-known to those skilled in the art. First, the expected static temperature rise or continuous current carrying capability of the conductors. Second, the conductors' capability to handle a momentary short circuit condition without fusing or their capability to carry a predetermined number of watts during the short circuit condition.

Preferably, the cross-sectional depth of the inventive conductors is non-uniform. This allows a unitary, one-piece conductor to connect components positioned in two different planes without undue bends in the conductor itself. As specifically illustrated in FIGS. 4 and 5, the neutral conductors 134, 234 at points 300, 302 respectively, connect the coil assemblies 130, 230 and neutral terminals 154, 254 which are positioned in two different planes relative to the base back walls 122, 222. The depth of the neutral conductors 134, 234, is increased for a short segment and then decreased to its original depth in another plane.

The rigidity of the assembled inventive conductor is further increased by increasing the cross-sectional depth along a short segment of the conductor. For example, as illustrated in FIG. 4, the neutral conductor 134 is supported against the circuit board 128 by increasing the depth of the conductor to form legs 304. Another example of increasing the rigidity of the assembled conductors is illustrated in FIG. 5, wherein the depth of the phase conductor 232 and the bottom of the first slot 274 have predetermined values so that the phase conductor 232 is supported by the bottom of the first slot 274.

Other advantages of the present invention are illustrated by the preferred embodiments in FIGS. 4 and 5. The inventive conductors provide more easily assembled and repeatable electrical connections with other components of the ground fault module than by using wires. For example, the legs 304 in FIG. 4 also provide electrical connection with the tracings on the circuit board 128. Furthermore, the cross-sectional shape of the conductors assists in making electrical connections with other components. For example the spot weld between the conductor end 136 and the conductor terminal 138 is more easily made against the flat side of phase conductor 132.

Since the inventive conductors are solid, a higher cross-sectional area is provided than a comparably sized multi-strand wire. Thus, the inventive conductors can carry higher current surges. The non-insulated, solid conductors of the present invention also eliminate several failure modes of multi-strand wire caused by high temperatures generated during current surges, i.e., fusing the strands of wire together or the degradation of the insulation.

The rigidity of the inventive conductors offers other advantages. The rigid inventive conductors allow for precise handling and positioning in an automated assembly process. The resultant assemblies are also easier to test using automated equipment because the rigid conductors are more accurately located. The inventive conductors also allow more accurate calibration and reliable dielectric testing because the dielectric variances caused by wires changing position during assembly, testing, or operation are eliminated.

The reliability of the present invention is also enhanced by the connection between the conductors and terminals. As the threaded fasteners are tightened, the power line and conductor are squeezed against the terminal lug body. The strain caused by the torque on the fastener is absorbed by the terminal lug body abutting the upstanding walls defining the base cavity. Thus, the conductors are free from torsional strain and the deleterious consequences on the other components of the ground fault module.

As illustrated, the inventive conductors provide a direct electrical connection between the terminals of a ground fault module. The use of wire leads or connectors is eliminated. Assembly of the module is made easier and inventory costs are lowered with fewer parts needed.

The inventive conductors were tested to prevent conductance during high voltage surges. This impulse dielectric test assures that there is ample clearance between the conductors and other components of the ground fault module to prevent arcing. The present invention withstood at least a 7 kV pulse test without an arcing failure.

As those skilled in the art will appreciate, the inventive conductors and terminals can be adapted and configured for use with a wide variety of circuit breakers and other circuit interrupters. The inventive conductors and terminals are suitable for use in low, medium, and high voltage applications and in various phase configurations. The term circuit interrupter is defined to include but not be limited to, single or polyphase circuit breakers, GFCI receptacles, vacuum or air circuit breakers, fusible switches, switchgear, and the like.

The conductors and terminals described above can be advantageously used for ground fault modules in all types of GFCIs and ground fault equipment. Three types of GFCI are commonly available. The first or separately enclosed type is available for 120-volt 2-wire and 120/240-volt 3-wire circuits up to 30 amp. The second type combines a 15-, 20-, 25-, or 30-amp circuit breaker and a GFCI in the same plastic case. It is installed in place of an ordinary breaker in a panelboard and is usually available in 120-volt 2-wire, or 120/240-volt 3-wire types which may also be used to protect a 2-wire 240-volt circuit. The second type provides protection against ground faults and overloads for all outlets on the circuit. A third type having a receptacle and a GFCI in the same housing provides only ground-fault protection to the equipment plugged into that receptacle. There are feed-through types of GFCI which provide protection to equipment plugged into other ordinary receptacles installed downstream on the same circuit.

Examples of ground fault equipment are commercially available from the Square D Company under the catalog designations GROUND-CENSOR TM, HOMELINE$^R$, QO$^R$, TRILLIANT$^R$ and MICROLOGIC$^R$ ground fault modules. This ground fault equipment is suitable for protection of main, feeder, and motor circuits on electrical distribution systems. It is also useable as ground fault relay and ground fault sensing devices.

While particular embodiments and applications of the present invention have been illustrated and described, it is to be understood that the invention is not limited to the precise construction and compositions disclosed herein and that various modifications, changes, and variations which will be apparent to those skilled in the art may be made in the arrangement, operation, and details of construction of the invention disclosed herein without departing from the spirit and scope of the invention as defined in the appended claims.

What is claimed is:

1. A housing assembly for a ground fault circuit interrupter connected between the load and line terminals of a phase and neutral power line, the assembly comprising:

a base made of electrically insulating material, the base having a plurality of cavities, each cavity being defined by upstanding side, top, and bottom walls integrally formed with the base, each cavity having one face open parallel to the base;

a first of the plurality of cavities being adapted to retain a circuit board between the upstanding walls and the base whereby the circuit board is inserted into the first cavity along an axis perpendicular to the open face;

a second of the plurality of cavities being positioned adjacent to the first cavity, the second cavity having a first slot in one of the upstanding side walls, the first slot connecting the first and second cavities and being adapted to insert a phase conductor therethrough, the second cavity having a second slot in the opposite upstanding side wall, the second slot allowing access external to the assembly and being adapted to insert a load phase power line therethrough, the second cavity having a third slot in the upstanding top wall, the third slot allowing access external to the assembly and being adapted to insert a terminal fastener therethrough, the second cavity being adapted to retain a phase terminal whereby the phase terminal is inserted into the second cavity along an axis perpendicular to the open face with the upstanding walls abutting the phase terminal; and a third of the plurality of cavities being positioned adjacent to the first cavity, the third cavity having a first slot in one of the upstanding side walls, the first slot connecting the first and third cavities and being adapted to insert a neutral conductor therethrough, the third cavity having a second slot in the opposite upstanding side wall, the second slot allowing access external to the assembly and being adapted to insert a load neutral power line therethrough, the third cavity having a third slot in the upstanding top wall, the third slot allowing access external to the assembly and being adapted to insert a terminal fastener therethrough, the third cavity being adapted to retain a neutral terminal whereby the neutral terminal is inserted into the third cavity along an axis perpendicular to the open face with the upstanding walls abutting the neutral terminal.

2. The assembly of claim 1 wherein the assembly further comprises a cover for the base, the cover abutting the top ends of the upstanding walls defining the plurality of cavities.

3. The assembly of claim 1 wherein one of the third or second cavities is more deep than the other so that the neutral and phase terminals respectively retained therein are positioned in different spatial planes to minimize the potential for arcing.

4. The assembly of claim 1 wherein the assembly further comprises a terminal shield having a generally flat shape and size to substantially cover the third slot of the third cavity, one end of the terminal shield is adapted to be removably secured to the base near the top wall of the third cavity, the terminal shield is made of electrically-insulating material.

5. The assembly of claim 1 wherein the bottom of the first slots of the second and third cavities has a predetermined depth for supporting the phase and neutral conductors extending through the upstanding side walls.

6. A ground fault circuit interrupter for protecting a circuit connected between the load and line terminals of a phase and neutral power line, the interrupter comprising:

an electrically-insulating housing having a base, the base having a plurality of cavities, each cavity being defined by upstanding side, top, and bottom walls integrally formed with the base, each cavity having one face open parallel to the base, a first of the plurality of cavities being adapted to retain a ground fault module between the upstanding walls and the base whereby the module is inserted into the first cavity along an axis perpendicular to the open face, a second of the plurality of cavities is positioned adjacent to the first cavity, the second cavity has a first slot in one of the upstanding side walls, the first slot connects the first and second cavities and inserts the phase conductor therethrough, the second cavity has a second slot in the opposite upstanding side wall, the second slot allows access external to the assembly and inserts the load phase power line therethrough, the second cavity has a third slot in the upstanding top wall, the third slot allows access external to the assembly and inserts the terminal fastener therethrough, the second cavity retains the phase terminal whereby the phase terminal is inserted into the second cavity along an axis perpendicular to the open face with the upstanding walls abutting the phase terminal, and a third of the plurality of cavities is positioned adjacent to the first cavity, the third cavity has a first slot in one of the upstanding side walls, the first slot connects the first and third cavities and inserts the neutral conductor therethrough, the third cavity has a second slot in the opposite upstanding side wall, the second slot allows access external to the assembly and inserts the load neutral power line therethrough, the third cavity has a third slot in the upstanding top wall, the third slot allows access external to the assembly and inserts the terminal fastener therethrough, the third cavity retains the neutral terminal whereby the neutral terminal is inserted into the third cavity along an axis perpendicular to the open face with the upstanding walls abutting the neutral terminal; and a ground fault module having:

means for sensing a current imbalance between the phase and neutral power lines, the sensing means being mounted within the circuit interrupter;

a phase conductor having a rigid, elongated body made of solid, electrically-conducting material, the phase conductor having a first and second end, the first end being adapted for connection to the load phase power line, the second end being adapted to fasten to the line phase power line, the phase conductor being operatively connected to the sensing means;

a neutral conductor having a rigid, elongated body made of solid, electrically-conducting material, the neutral conductor having a first and second end, the first end being adapted for connection to the load neutral power line, the second end having a terminal adapted for electrical connection to the line neutral power line, the neutral conductor being operatively connected to the sensing means; and a phase lug and a neutral lug, each lug having an oval shaped body and a threaded fastener for reversibly clamping one of the conductors between the fastener and the lug body, the first end of the phase conductor is shaped to insert into the body of the phase lug for clamping between the phase lug fastener and body, the first end of the neutral conductor is shaped to insert into the body of the neutral lug for clamping between the neutral lug fastener and body.

7. The interrupter of claim 6 wherein the sensing means comprises a coil assembly having a plurality of windings made of an electrically-conducting material so that a magnetic field is generated when the windings are energized, the phase and neutral conductors are positioned to intersect the magnetic field.

8. The interrupter of claim 6 wherein the module further comprises a circuit board and an electronic signal processor, the electronic signal processor is connected to the sensing means for determining ground fault conditions between the phase and neutral power lines and providing an output signal adapted to interrupt current flow through the circuit, the electronic signal processor and the sensing means are mounted on the circuit board.

9. The interrupter of claim 8 wherein the module further comprises a solenoid electrically connected at one end to the circuit board and at the other end to the second end of the neutral conductor, whereby the solenoid absorbs any high voltage input at the line neutral terminal.

10. The assembly of claim 6 wherein one of the third and second cavities is more deep than the other so that the neutral and phase terminals respectively retained therein are positioned in different spatial planes to minimize the potential for arcing.

11. The interrupter of claim 6 wherein the dimensional depth of the phase and neutral conductors is non-uniform to provide means for electrically and mechanically connecting the conductors directly to the circuit board.

12. The interrupter of claim 6 wherein the dimensional depth of the phase and neutral conductors is non-uniform to provide means for spanning two different planes without bending and for laterally supporting the conductors by abutting the circuit interrupter.

* * * * *